US009779866B2

(12) United States Patent
Doljack

(10) Patent No.: US 9,779,866 B2
(45) Date of Patent: Oct. 3, 2017

(54) OPTIMIZED ELECTROMAGNETIC ACTUATOR COMPONENT DESIGN AND METHODS INCLUDING IMPROVED CONDUCTIVITY COMPOSITE CONDUCTOR MATERIAL

(71) Applicant: COOPER TECHNOLOGIES COMPANY, Houston, TX (US)

(72) Inventor: Frank Anthony Doljack, Pleasanton, CA (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 0 days.

(21) Appl. No.: 14/511,364

(22) Filed: Oct. 10, 2014

(65) Prior Publication Data

US 2016/0104562 A1 Apr. 14, 2016

(51) Int. Cl.
*H01F 7/08* (2006.01)
*H01F 7/16* (2006.01)

(52) U.S. Cl.
CPC ..... *H01F 7/081* (2013.01); *H01F 7/08* (2013.01); *H01F 7/1607* (2013.01); *H01F 7/1638* (2013.01)

(58) Field of Classification Search
CPC ..... H01F 7/08; H01F 7/1638; H01F 7/1607; H01F 7/081
See application file for complete search history.

(56) References Cited

U.S. PATENT DOCUMENTS

2006/0138646 A1* 6/2006 Aisenbrey ..... H01B 1/22 257/712
2012/0020117 A1* 1/2012 Arnold ..... H01F 29/10 363/15

* cited by examiner

*Primary Examiner* — Mohamad Musleh
(74) *Attorney, Agent, or Firm* — Armstrong Teasdale LLP

(57) ABSTRACT

Electromagnetic actuator components include a magnetic core, a conductor assembled with the core and defining a winding completing a number of turns, and a movable component that may be displaced by a magnetic field. The conductor is fabricated from a composite material including carbon nanotubes having an improved conductivity. The conductor has a cross section defined by an effective diameter. The conductor is fabricated to have performance parameters that are selected in view of a function of a ratio of conductivity and/or a function of a ratio of effective diameter of the composite conductor material relative to a reference conductor material as conventionally used in an electromagnetic actuator fabrication.

34 Claims, 8 Drawing Sheets

OPTIMIZED ELECTROMAGNETIC ACTUATOR COMPONENT DESIGN AND METHODS INCLUDING IMPROVED CONDUCTIVITY COMPOSITE CONDUCTOR MATERIAL

BACKGROUND OF THE INVENTION

The field of the invention relates generally to the design and manufacture of electromagnetic components and related design and fabrication methods, and more particularly to the manufacture of electromagnetic actuators.

Electrical devices, including but not necessarily limited to relays, contactors, switchgear and circuit breaker devices sometimes employ electromagnetic actuators to disconnect or break a circuit path in an electrical power distribution system when electrical overcurrent or overload conditions are detected.

Switchgears and relays, for example, generally include two sets of contacts, one of them typically being movable and the other being stationary. The movable contact is moved by electromagnetic actuators including a coil wound around a core. When current flows through the coil (i.e., when the electromagnetic actuator is energized), a magnetic field is produced in the core, which displaces an actuator element (e.g. a plunger) in the assembly. The plunger in turn moves the movable contact of the switchgear or relay towards the fixed or stationary contact. The force developed by the electromagnet holds the movable and stationary contacts together. When the electromagnetic actuator coil is de-energized (i.e., when current ceases to flow through the coil), gravity or a bias element such as a spring returns the plunger to its initial position and opens the contacts. This operation can be reversed by mechanical design such that when the plunger moves during actuation the contacts will open rather than close.

Solenoid valves are used in fluid power, pneumatic and hydraulic systems, to control cylinders, fluid power motors or larger industrial valves. They generally also include a plunger adapted to move in a desired way to open and close gates of the valve and allow passage of fluids. Movement of the plunger happens in presence of a magnetic field generated in the core of an electromagnetic actuator when the coil of electromagnetic actuator is energized.

Electromagnetic manufacturers are facing an increased demand to reduce the size and power loss of electrical and or hydraulic systems that are used is variety of applications, including but not limited to complex industrial applications, aviation applications, high voltage switchgear and electrical power distribution systems, and vehicle applications such as power door locks or central locking applications. While the demand for increasingly smaller and energy efficient electrical and/or hydraulic systems is growing, electromagnetic actuator manufacturers face practical challenges in reducing the size and power loss of electromagnetic actuators to meet the desires of the marketplace. By decreasing the size and power loss of the actuators in electrical and hydraulic systems, not only the size and energy efficiency of devices employing such actuators can be reduced, but also the performance and capabilities of electrical and/or hydraulic systems can be enhanced. Improvements are therefore desired.

BRIEF DESCRIPTION OF THE DRAWINGS

Non-limiting and non-exhaustive embodiments are described with reference to the following figures, wherein like reference numerals refer to like parts throughout the various drawings unless otherwise specified.

DETAILED DESCRIPTION OF THE INVENTION

Figure 1:
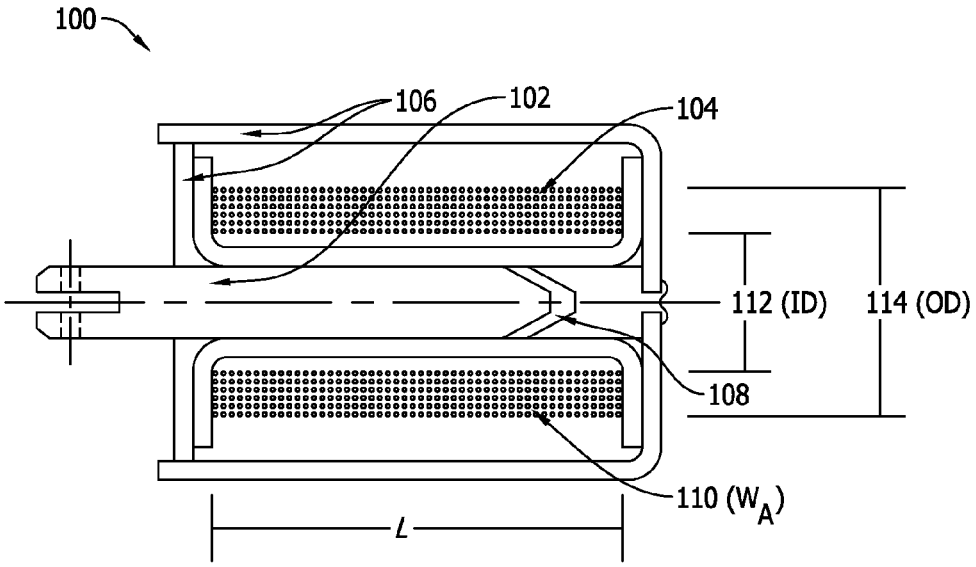
FIG. 1 is a front view of a first exemplary embodiment of an electromagnetic actuator formed in accordance with an exemplary embodiment of the invention and including an improved conductivity composite conductor material.

Exemplary embodiments of electromagnetic actuators are described hereinbelow that advantageously meet longstanding and unresolved needs in the field to provide smaller electromagnetic actuator components with enhanced performance capabilities. Electromagnetic actuator design and fabrication techniques are disclosed that allow for smaller electromagnetic actuator components with comparable or better performance than existing designs using conventional electromagnetic design and fabrication techniques. Method aspects will be in part apparent and in part explicitly discussed in the description below in which the technical advantages and benefits of the inventive concepts are described.

As used herein, the term "actuator" shall refer to an electromagnetic actuator that provides a desired physical movement of a movable component in an hydraulic or electrical device or system. More specifically, an electromagnetic actuator operates via magnetism induced within a magnetic core when a coil or winding assembled with the core is energized and electrical current flows through the coil. The current flow in the coil induces a magnetic field in the core, and the induced magnetism propels or displaces an actuator element such as a plunger (or other movable component) in a desired way from an initial position to another position relative to the core. Associated movement of the plunger effects a desired operation in an electrical or hydraulic device system or assembly. For example, the plunger, when displaced by the magnetism may make or break an electrical connection in a circuit, or may open or close a valve in a hydraulic system.

Presently available electromagnetic actuators include a core made of a magnetic material(s) and one or more coils made of copper wound over the core in various arrangements and positions to render a desired physical effect on a movable component. The movable actuator element or actuator component in the assembly may be a plunger that is physically not connected to the core but is nonetheless movable relative to the core between desired positions under the influence of induced magnetism. Alternatively, the movable actuator component (e.g., a plunger) may be physically connected to the core, for example, at one end and may pivot relative to the core at the one end with the other end freely movable under the influence of induced magnetism. While these two arrangements are the most prevalent in electromagnetic actuators in use today, still other arrangements are possible, including ones in which a plunger or other component is fixed or mounted in a stationary position and other components or parts (e.g., a magnetic core) are movable relative to the plunger under the influence of induced magnetism, in which the case the magnetic core itself becomes an actuator element to effect a desired operation in electrical or hydraulic systems.

The engineering principles of electromagnetic actuator component design are well known but difficult to apply in some aspects, and as a result the manufacture of electromagnetic actuator components is partly experimental in nature. That is, electromagnetic actuator component manufacturers tend to adopt electromagnetic actuator designs through an iterative process wherein a design may be developed in a theoretical manner, prototypes of the design may be made and tested to evaluate the theoretical design, changes are proposed in view of the test results, and another round of components is made and tested. Such a process may be, and has been, successfully accomplished to provide satisfactory electromagnetic actuator components meeting desired specifications in certain aspects. To some extent, because of the number of actuator designs that are known for certain applications, the theoretical design step may be omitted and one may instead attempt to simply change an existing electromagnetic actuator design and proceed with testing of prototypes to assess the impact of the change.

Because of the experimental nature of the electromagnetic actuator component design, a design may be achieved that meets a desired specification but is nonetheless sub-optimal. Because the impact of a design change in one aspect of the actuator component design and manufacture to other aspects of the resultant actuator component are not well understood or easy to predict, there is typically some trial and error in arriving at a final actuator design that meets a specification in a desired attribute, but once the specification is met it may have negatively (and unknowingly) affected another performance attribute. This is perhaps even more so in the manufacture of increasingly smaller, if not miniaturized, actuator components that are desirably provided in smaller packages and design envelopes.

Regarding the fabrication of the coils for electromagnetic actuator components, copper is and has been predominately the conductive material of choice by electromagnetic component manufacturers. Coils and windings fabricated from copper have been effectively utilized to provide adequate actuator performance in combination with a variety of magnetic materials to fabricate the magnetic core including the windings in increasingly smaller packages. Great efforts have been made in recent times, with some success, to manufacture smaller electromagnetic actuator components and/or to increase the power capabilities of electromagnetic actuator components that are already quite small.

However, the use of copper to fabricate the coils of electromagnetic actuator components is believed to impose a ceiling to the development of higher performing actuators and/or to provide comparable performance to existing actuators in smaller package sizes. In other words, the performance potential of copper windings and known magnetic materials is believed to have reached its peak, such that copper-based windings and coils have little more to offer in terms of providing performance improvement and reduction in size of electromagnetic components. Because the demand for further size reduction and miniaturization of actuator components having improved performance has not subsided, a new approach is needed to further improve electromagnetic actuator performance, reduce the size of electromagnetic actuator components, and also to reduce the cost of electromagnetic actuator components.

In order to achieve increased performance while continuing to reduce the size of electromagnetic actuator components, the present invention proposes the use of a composite conductive material for fabricating the coils of the electromagnetic actuator component. In contemplated examples, the composite conductive material has a conductivity that is greater than copper to facilitate still further improvement in performance of electromagnetic actuators. In contemplated embodiments, the composite conductive material may include known conductive metals, or conductive metal alloys, in combination with carbon nanotubes (hereinafter CNTs). Metals such as copper, silver or other metals and alloys, for example, may be enhanced with CNTs to provide superior electrical properties to those of the metal or metal alloys alone (i.e., the metal or metal alloys without CNTs). Using CNT enhanced materials having improved conductivity, direct current resistance (DCR) that relates to power loss in use, may be reduced. In the DCR and other performance aspects described below, electromagnetic actuator components may be improved beyond the capabilities of conventional electromagnetic actuator design. That is, actuator components utilizing CNT enhanced materials, among other things, may operate with reduced total power loss, and hence higher efficiency, than conventionally fabricated electromagnetic actuators.

Referring now to FIG. 1, there is shown an exemplary electromagnetic actuator 100 having an arrangement in which an actuator element in the form of a plunger 102 is movable when a coil 104 wound around a core 106 is energized (or an alternating current passes through them), thereby generating a magnetic field within the core 106 and plunger 102 (in other words when the magnetism is induced within the core and the plunger). The plunger 102 is a linear plunger that is movable linearly within a gap 108 under the influence of magnetic field generated within the core 106 and the plunger 102. The coil 104 that is wound around the core 106 and is contained in a specified area around the core 106 where they are wound which is called as window area 110. The coil 104 is evenly spaced within the window area ($W_A$) 110 and extends across a length L as shown in FIG. 1. The coil 104 in the embodiment shown includes multiple layers, where an inner layer has an effective inner diameter (ID) 112 calculated from the center of the core 106, and the outermost layer has an effective outer diameter (OD) 114. The coil 104 within the actuator has a specified number of turns N which is decided based on the design calculations for a particular end use or application of the actuator 100.

Figure 2:
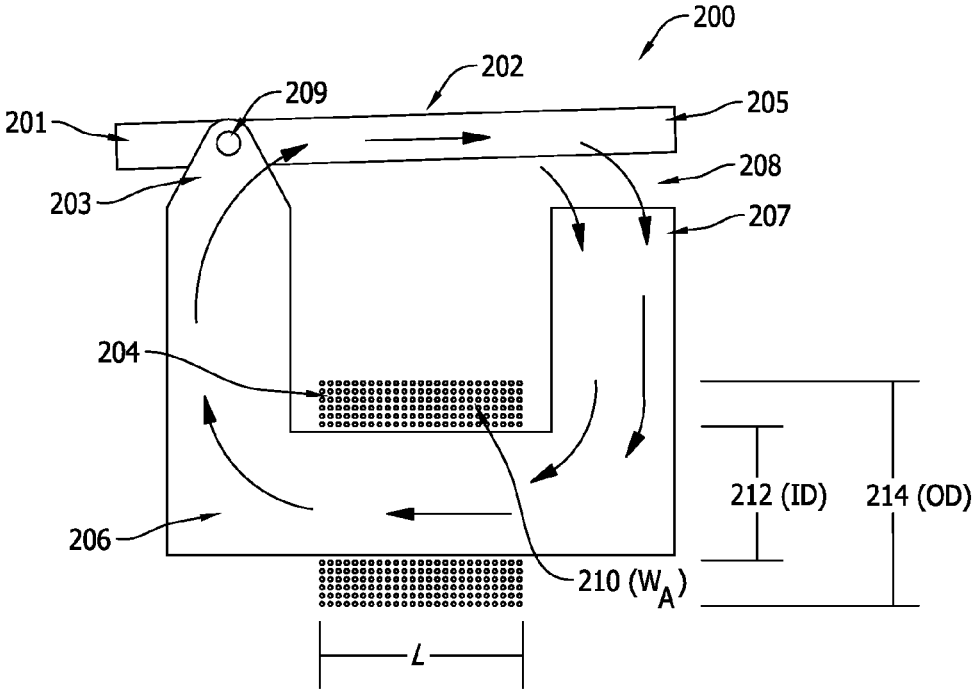
FIG. 2 is a front view of a second exemplary embodiment of an electromagnetic actuator formed in accordance with an exemplary embodiment of the invention and including an improved conductivity composite conductor material.

Referring to FIG. 2, there is shown an exemplary electromagnetic actuator 200 having an arrangement in which an actuator element such as a plunger 202 is fixed to a core 206. An end 201 of the plunger 202 is fixed to an end 203 of the core 206 with a pivotal hinge 209. The other end 205 of the plunger 202 is rotationally movable along the pivotal hinge 209 and upon actuation moves to an end 207 of the core 206. The initial position of the plunger 202 can be restricted to certain degrees from the core end 207 of the core 206, which creates an air gap 208. The core 206 and plunger 202 are made of a magnetic material known in the current state of the art. A coil 204 is wound over the core 206. The area of the core 206 around which the coil 204 is wound is called a window area ($W_A$) 210. The coil 204 extends across a length "L" of the core 202. The coil 204 has multiple layers, where the inner layer has an effective inner diameter (ID) 212 calculated from the center of the core 206, and the outermost layer has an effective outer diameter (OD) 214. The coil 204 within the actuator 200 has a specified number of turns N which is decided based on the design calculations for a particular use/application.

Figure 3:
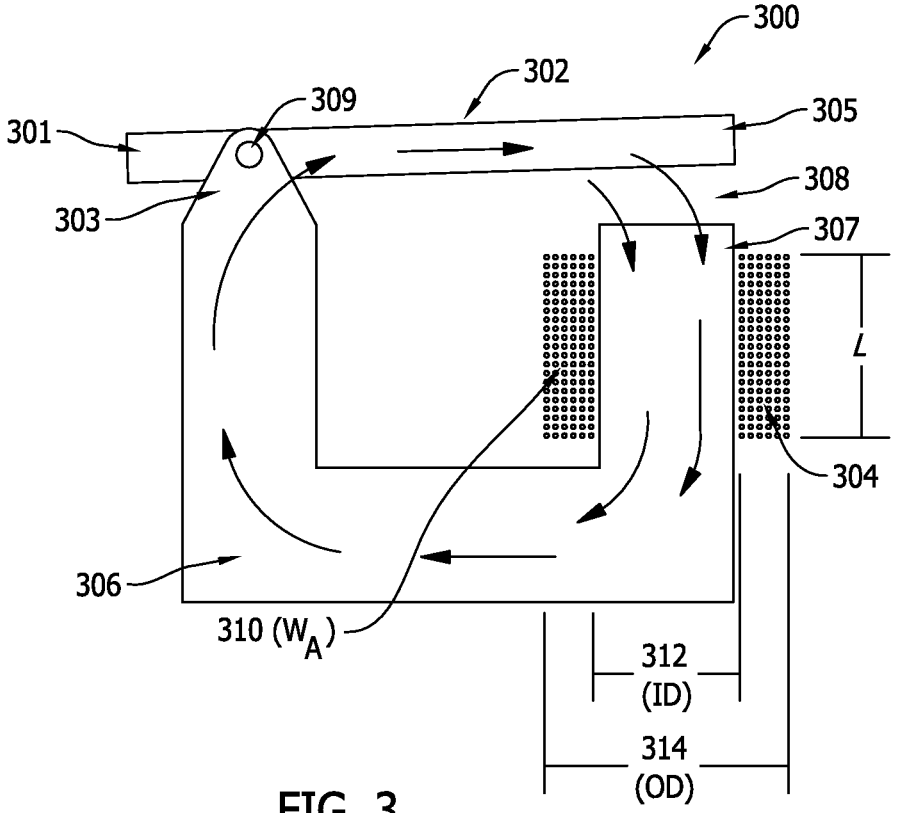
FIG. 3 is a front view of a third exemplary embodiment of an electromagnetic actuator formed in accordance with an exemplary embodiment of the invention and including an improved conductivity composite conductor material.

Referring to FIG. 3, there is shown an exemplary electromagnetic actuator 300 similar to the one shown in FIG. 2. The exemplary electromagnetic actuator 300 includes an arrangement in which a plunger 302 is fixed to a core 306. An end 301 of the plunger 302 is fixed to an end 303 of the core 306 with a pivotal hinge 309. The other end 305 of the plunger 302 is rotationally movable along the pivotal hinge 309 and upon actuation moves to an end 307 of the core 306. The initial position of the plunger 302 can be restricted to certain degrees from the core end 306 of the core 306, which creates an air gap 308. The core 306 and plunger 302 are made of a magnetic material known in the current state of the art. A coil 304 is wound over the core 306. The area of the core 306 around which the coil 304 is wound is called a window area ($W_A$) 310. The coil 304 extends across a length "L" of the core 302. The coil 304 has multiple layers, where the inner layer has an effective inner diameter (ID) 312 calculated from the center of the core, and the outermost layer has an effective outer diameter (OD) 314. The coil 304 within the actuator 300 has a specified number of turns N which is decided based on the design calculations for a particular end use or application of the actuator 300.

The electromagnetic actuator 200 of FIG. 2 and electromagnetic actuator 300 of FIG. 3 are substantially similar with the main difference between them being that in the actuator 200 length "L" of the core across which the coil 204 extends is fixed and in order to decrease the size of the actuator without affecting its intended operation only the effective outer diameter (OD) 214 can be decreased. On the other hand, in the electromagnetic actuator 300 only the length "L" across which the coil 304 extends can change, and the effective outer diameter (OD) diameter 314 of the outermost layer of the coil 304 cannot change in order to similarly decrease its size without affecting its intended operation.

While three different types of electromagnetic actuators 100, 200, and 300 are described in the preceding figures, it must be appreciated the actuators shown are provided for the sake of illustration rather than limitation. Other types of electromagnetic actuators beyond those shown and described may benefit from the inventive concepts described herein. Also, the actuators 100, 200, or 300 and other contemplated embodiments may further be provided with bias springs and the like to enhance operation of the assembly and achieve desired effects. For example, in some embodiments including a bias element, the magnetic field and force must overcome a resistance of a bias element to displace the actuator element to a desired position, and when the coil is de-energized and magnetic field and force ceases the bias element can return the actuator element (e.g., a plunger) to its original position.

In each of the actuator embodiments shown and described the cores 106, 206 and 306 and plungers 102, 202, and 302 are fabricated from magnetic materials having a desired magnetic permeability. More specifically, the cores 106, 206 and 306 and plungers 102, 202, and 302 can be fabricated from iron, iron alloys, or ferrimagnetic ceramic materials, other suitable magnetic materials, and combinations thereof. The cores 106, 206 and 306 and plungers 102, 202, and 302 can be formed in single pieces or multiple pieces that are assembled into a larger core structure. Each core 106, 206 and 306 and plungers 102, 202, and 302 (or the pieces of each core 106, 206 and 306 and plungers 102, 202, and 302 as the case may be) can be independently fabricated into desired shapes using granular powder materials and molding processes in contemplated embodiments. Alternatively, the cores 106, 206 and 306 and plungers 102, 202, and 302 (or the pieces of each core 106, 206 and 306 and plungers 102, 202, and 302 as the case may be) can be fabricated by stacking and joining multiple blocks or sheets of magnetic material that may be pre-formed in some embodiments.

For example, magnetically responsive sheet materials may be provided to include soft magnetic particles dispersed in a binder material, and may be provided as freestanding thin layers or films that may be assembled in solid form, as opposed to semi-solid or liquid materials that are deposited on and supported by a substrate material. Soft magnetic powder particles may be used to make the magnetic composite sheets, including Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, cobalt-based amorphous powder particles, and other suitable materials known in the art. Combinations of such magnetic powder particle materials may also be utilized if desired. The magnetic powder particles may be obtained using known methods and techniques. Optionally, the magnetic powder particles may be coated with an insulating material.

After being formed, the magnetic powder particles may be mixed and combined with a binder material. The binder material may be a polymer based resin having desirable heat flow characteristics in the layered construction of a magnetic core for higher current, higher power use of the actuator 100, 200 or 300. The resin may further be thermoplastic or thermoset in nature, either of which facilitates lamination of the sheet layers provided with heat and pressure. Solvents and the like may optionally be added to facilitate the composite material processing. The composite powder particle and resin material may be formed and solidified into a definite shape and form, such as substantially planar and flexible thin sheets. Further details of pre-formed magnetic sheet layers are described in the commonly owned U.S. patent application Ser. No. 12/766,382, the entire disclosure of which is hereby incorporated by reference. Insulator sheets may be used in combination with magnetic sheets as desired, or the magnetic sheets may be joined in surface contact without any intervening layers between them.

It must be understood that the above examples are non-limiting and other core types can also be used in the electromagnetic actuators without departing from the spirit of the invention.

In the embodiments shown, the coil 104, 204 and 304 is fabricated from an ultra-conductive composite material conductor. The composite conductive material utilized may contain 1-99%, or even 100%, by weight of carbon nanotubes (CNTs) along with metal or metal alloys, such as copper, copper alloys, aluminum, or aluminum alloys. In various contemplated embodiments, the composite conductive material including CNTs may be fabricated into flexible wire conductors that may be wound into a winding for assembly with a magnetic core piece, may be fabricated into layers of material from which conductors may be stamped and shaped into a desired geometric configuration, or may be deposited on substrate materials using known techniques. Single walled CNTs or multiple walled CNTs may be utilized and bonded to or otherwise joined with a metal or metal alloy to provide a composite material having improved conductivity relative to copper and other known metals that have been used to fabricate coils in conventional electromagnetic actuator fabrication. Consortiums of companies and universities have been established to develop such composite conductive materials and their manufacture.

The ultra-conductive coil conductor including the CNTs may include a metal or metal alloy core, and carbon nanotube (CNT) cladding. In contemplated embodiments, the conductivity of the composite material may be about 1.1 to about 10 times that of copper. The ultra-conductive material used to fabricate the coils 104, 204 and 304 can be made using any suitable process.

Figure 4:
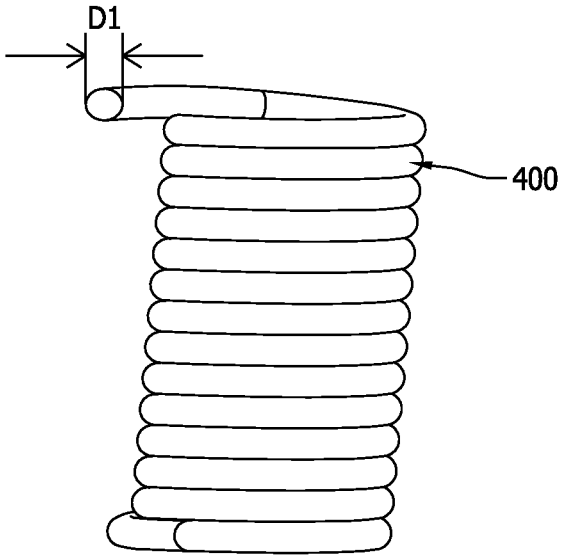
FIG. 4 is a perspective view of an exemplary coil configuration that may be utilized in an exemplary embodiment of an electromagnetic actuator formed in accordance with an exemplary embodiment of the invention including an improved conductivity composite conductor material.

Various coil geometries and coil cross-sections are possible as shown in FIGS. 4-7. Referring to FIG. 4, there is shown a coil 400 fabricated from a composite ultra-conductive conductor material wire wound for a number of turns to complete a coil. As seen in FIG. 4 at one end of the coil 400, the conductor has a round or circular cross section including a diameter D1. The diameter D1 of the round wire may vary in different embodiments, and the cross sectional area of the conductor likewise varies with the selected diameter D1.

Figure 5:
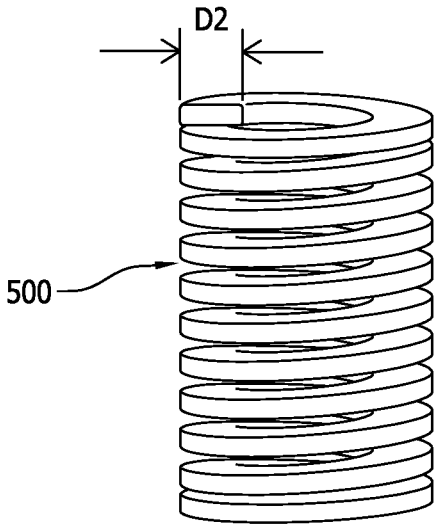
FIG. 5 is a perspective view of an exemplary coil configuration that may be utilized in an exemplary embodiment of an electromagnetic actuator formed in accordance with an exemplary embodiment of the invention including an improved conductivity composite conductor material.

FIG. 5 illustrates a coil 500 also fabricated from a composite ultra-conductive conductor material and wound for a number of turns to complete a coil. As seen in FIG. 5 at one end of the coil 500, the conductor has a rectangular cross section including a major dimension D2. The conductor shown in the coil 500 is sometimes referred to as a flat wire coil, whereas the conductor shown in the coil 400 (FIG. 4) is referred to as a round wire coil. The dimension D2 of the flat wire may vary in different embodiments, and the cross sectional area of the conductor likewise varies with the selected dimension D2.

If a coil wire has cross-sectional shape other than round, as shown in the example of FIG. 5, its effective "diameter" for purposes of the present invention shall be deemed to be the diameter of a round wire with equivalent cross-sectional area. As one example, if the major dimension D2 has a value (e.g., 6 in a unit length) in a given embodiment, and the minor dimension measured in a direction perpendicular to the major dimension D2 in FIG. 5 has a value (e.g., 2 in the same unit length), the cross sectional area of the conductor is the product of these two values or 12 square units. A diameter of a circular cross section having the same 12 square units in cross sectional area can be computed by first finding the radius of a circular cross section using the following relationship for a circular cross section: $A=\pi r^2$, where the diameter D of the circular cross section is equal to twice the radius R. In this example where A is 12 square units, the radius r can be computed and is seen to be 1.95. The diameter of a round cross section having the area of 12 is therefore twice the radius (e.g., 1.95×2) or 3.9. The conductor shown in FIG. 5 having a rectangular cross sectional area of 12 square therefore has an "effective diameter" of 3.9 for purposes of the present invention.

Figure 6:
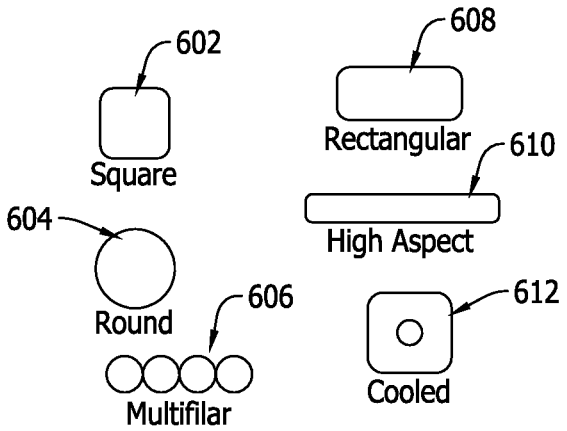
FIG. 6 illustrates alternative cross sections of conductors that may be utilized to fabricate coil(s) for exemplary embodiments of an electromagnetic actuator formed in accordance with an exemplary embodiment of the invention including an improved conductivity composite conductor material.

FIG. 6 shows additional cross sectional areas of ultra-conductive composite conductor materials that may be utilized to fabricate coil in electromagnetic actuators according to the present invention. In the examples shown in FIG. 6, the cross sections may be square as shown in the example conductor 602, round or circular as shown in the example conductor 604, multifilar as shown in the example conductor 606, rectangular as shown in the example conductor 608, a high aspect ratio cross section as shown in the example conductor 610, and a cooled cross section as shown in the example conductor 612. For each of these cross sections of conductors, an "effective diameter" can be computed in a similar manner to the example above. In the case of a round cross section such as in the conductor 604, the effective diameter is equal to the actual diameter of the round conductor.

Of course, the exemplary conductors and cross sections illustrated in FIG. 6 are exemplary only. Other conductors and cross sectional configurations are possible to construct coil for electromagnet actuators in further and/or alternative embodiments of the invention. Coil may be fabricated from such conductors to include any number of turns and/or arrangement of turns or layers. In multiple turn embodiments, a plurality of turns may be arranged concentrically with or without insulation in between. A plurality of coils may further be provided and may be electrically connected in series or in parallel. A plurality of coils may be arranged in a flux sharing relationship so that the coils are mutually coupled, or a plurality of uncoupled coils may be independently operable but nonetheless coupled to a common magnetic core structure.

Figure 7:
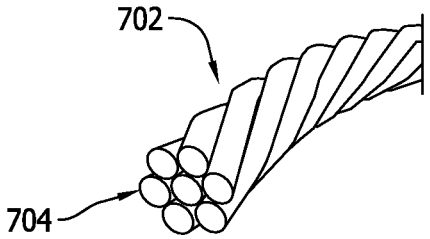
FIG. 7 illustrates an exemplary conductor that may be utilized to fabricate coil(s) for exemplary embodiments of an electromagnetic actuator including an improved conductivity composite conductor material.

FIG. 7 illustrates a conductor 702 that may be fabricated from ultra-conductive composite materials and wherein multiple conductor strands 704 are combined and twisted about one another to form a larger conductor 702. The conductor 702 may be provided as a length of wire that in turn may be wound for a number of turns to complete a coil having a mean length per turn (MLT). As used herein a "mean length per turn" shall refer to a portion of a conductive path defined in a coil having a number of turns. As also used herein the term "turn" shall refer to a portion of the conductive path that completes one full revolution of the conductive path in a loop. Each turn, sometimes referred to as a loop, has a beginning and an end. Where one turn ends the next turn begins, and the conductive paths repeat in a continuous fashion in the winding in the multiple turn configuration illustrated. The mean length per turn is therefore a reference to the length of conductor in the coil needed to complete on full turn. Referring to the coil examples shown in FIGS. 4 and 5, it can be seen that the coil in FIG. 4 completes about 14 turns that each generally round or circular in configuration and connected in a spiral pattern, whereas the example shown in FIG. 5 completes about 11 turns. While any number of turns may be utilized, generally speaking as the number of turns increases, the strength of the magnetic field induced in the core increases. The magnetic field and magnetic force to move the actuator element may therefore be varied for different applications.

The example conductor 702 shown in FIG. 7 may be recognized as a Litz wire or magnet wire, and the cross sectional area of the conductor 702 is equal to the sum of the cross sectional areas of the conductor strands. As such, in the illustrated example, seven conductor strands are utilized having the same circular cross sectional area, so the cross sectional area of the entire conductor is seven times the cross sectional area of the strands utilized. The effective diameter of the conductor for the purposes of the invention is then the diameter of a solid round wire with equivalent cross-sectional area of the conductor 702.

For example, if each strand has a cross sectional area of 2 square units and seven strands are utilized as shown, the conductor 702 has a cross sectional area of 14. Using the relationship above, the radius r of a circle having an area of 14 square units can be computed. In this example, the radius r is 2.11 and the diameter is therefore twice the radius (e.g., 2.11×2) or 4.22. The conductor shown in FIG. 7 having a cross sectional are of 14 square units therefore has an "effective diameter" of 4.22 for purposes of the present invention.

Figure 8:
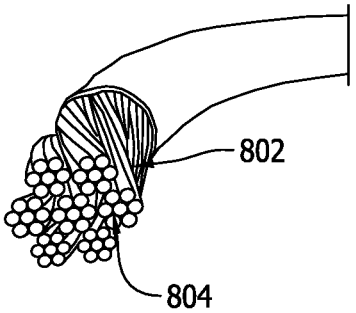
FIG. 8 illustrates an exemplary conductor that may be utilized to fabricate coil(s) for exemplary embodiments of an electromagnetic actuator including an improved conductivity composite conductor material.

FIG. 8 illustrates a conductor 802 that may be fabricated from ultra-conductive composite materials and wherein multiple conductor strands 804 are combined and twisted about one another to form a larger conductor 802. The conductor 802 may in turn be wound for a number of turns to complete a coil having a mean length per turn (MLT) as discussed above. The example conductor 802 shown in FIG. 8 may be recognized as a combination of conductors 702 such as that shown in FIG. 7, and the cross sectional area of the conductor 802 is equal to the sum of the cross sectional areas of the conductors 804. As such, in the illustrated example, seven conductors 804 are utilized to fabricate the conductor 802.

Continuing the example above, if each conductor 802 has a cross sectional area of 14 square units (2 square units per strand times seven strands), the cross sectional area of the entire conductor 280 is seven times the cross sectional area of the conductor strands (e.g., 7 times 14 or 98 square units). The effective diameter of the conductor for the purposes of the invention is then the diameter of a solid round wire with equivalent cross-sectional area of the conductor 280. Using the relationship above, the radius r of a circle having an area of 98 square units can be computed. In this example, the radius is 5.59 and the diameter is therefore twice the radius (e.g., 5.59×2) or 11.18. The conductor 280 shown in FIG. 8 having a cross sectional are of 98 square units therefore has an "effective diameter" of 11.18 for purposes of the present invention.

In accordance with embodiments of the invention, diameter of the coil is mainly dependent on the conductivity of the composite material and other parameters and can offer significant improvements in the coil wire diameter resulting in overall size reduction and reduced power losses.

In one aspect, the present invention utilizes a design approach referencing an existing or established electromagnetic actuator having certain attributes. That is, reference may be made to a reference actuator that has a reference core and plunger fabricated from a reference magnetic material and a reference coil fabricated form a conventional conductive metal material such as copper or copper alloy in one example. The conductivity of the copper material may be deemed a reference value of 1. Except as noted below, it is to be understood that the reference actuator and the improved actuator of the present invention have otherwise identical core and plunger shapes and are fabricated from the same magnetic materials. For instance, if the actuator of the present invention has a "U" shaped core then the reference actuator is assumed to have a "U" shaped core fabricated from the same magnetic material. For the sake of the present description, any parameter preceded by the word "reference" shall mean the corresponding parameter associated with the reference actuator, unless specified otherwise.

In accordance with the embodiments of the invention, a ratio of conductivity (simply referred to as conductivity (β) in rest of the specification) of the composite material used in coil 104 (of FIG. 1) or 204 (of FIG. 2) or 304 (of FIG. 3), relative to that of copper used in reference coil, affects the range of diameter of the coil or alternatively defines the range of a ratio of diameter of the conductor (drawn in to coil) relative to that of reference actuator's reference conductor (drawn into coil) diameter. Within this range of the diameter ratio (δ), the diameter of the conductors can be selected. For the matter of simplicity this ratio would be referred to as diameter ratio (δ) in the rest of description. Further, for a value of diameter ratio (δ) and conductivity (β) of composite material, some of the parameters of the actuator, such as Magnetizing Current (I), direct current resistance (DCR), window height ratio (χ), and number of turns (N) can be adjusted to achieve a desired performance of the actuator of the present invention including the improved conductivity material. The word "adjusted," in addition to its dictionary meaning, is supposed to mean selection, alteration, variation or deviation from the respective reference parameters of the reference actuator.

Generally, operation of an electromagnetic actuator is associated with parameters such as magnetic field density "B," a force on the magnetic poles in the air gap "F," and DC resistance of the coil "DCR." Based on well-known equations in electromagnetic actuator design, a relationship between these parameters other parameters such as mean length per turn (MLT), resistivity, magnetic path length ($l_m$), air gap distance (g), magnetic material permeability ($\mu_m$), permeability of free space ($\mu_0$), core and plunger cross-sectional area ($A_C$), wire cross-sectional area ($A_W$), winding window area ($W_A$), and winding window utilization factor ($K_U$) can be understood as per the equations provided below.

Ampere's Law applied to the magnetic path results in the following relationship:

$$B = \frac{\mu_0}{\frac{l_m}{\mu_m} + g + \text{stroke}} NI$$

The equation for the force on the magnetic poles in the air gap, as those in the art would appreciate is governed by the following relationship.

$$F = \frac{B^2 A_C}{2\mu_0}$$

Substituting B per the relationship above yields the following:

$$F = \frac{1}{2}\mu_0 A_C\left(\frac{\mu_0}{\frac{l_m}{\mu_m} + g + \text{stroke}} NI\right)^2$$

The coil resistance is governed by the following relationship.

$$DCR = \rho\frac{N(MLT)}{A_W}$$

The coil window is filled with the coil wire at a specified utilization factor as follows.

$$K_u W_A = NA_W$$

where $W_A$ is equal to:

$$W_A = L\frac{OD - ID}{2}$$

B is normally saturated at stroke=0, so the holding force is the maximum value that can be attained with the given NI.

Since plunger stroke (or rotational arm length) is fixed by design, the length L of the actuator's coil window area will not change in FIGS. 1 and 2 (FIG. 3 is considered later). The height only of the window area can change from the reference design. Since the force F (and B) is a maximum at stroke=0 the core cross-sectional area must also remain fixed. Therefore, in the equation for $W_A$ the inside diameter ID of the coil cannot change and is fixed. Only the outside diameter OD of the coil can change.

Since $$MLT = \frac{OD + ID}{2}$$

then MLT will change if OD changes in actuator 100 of FIG. 1 and actuator 200 of FIG. 2.

A design of improved electromagnetic actuator in terms of ratios relative to a reference actuator (FIG. 1 and FIG. 2) is made in view of the following relationship:

$$F_{max} = \frac{1}{2}\mu_0 A_C\left(\frac{\mu_0}{\frac{l_m}{\mu_m} + g} NI\right)^2 = \frac{1}{2}\mu_0 A_C\left(\frac{\mu_0}{\frac{l_m}{\mu_m} + g} N_{new} I_{new}\right)^2$$

In the above it is assumed without loss of generality that for the new actuator the effective gap lengths $$\frac{l_m}{\mu_m} + g$$

are the same as the reference actuator.

$$N'I' = \frac{N_{new} I_{new}}{NI} = 1 \tag{1}$$

The following equations apply to the actuator embodiments shown in FIGS. 1 and 2.

$$\chi = \frac{W_{Anew}}{W_A} = \frac{OD_{new} - ID}{OD - ID} = \frac{N_{new}}{N}\frac{A_{Wnew}}{A_W} = N'\delta^2 \tag{2}$$

$$MLT' = \frac{MLT_{new}}{MLT} = \frac{OD_{new} + ID}{OD + ID}$$

From equation (2), $OD_{new} = \chi OD + (1-\chi)ID$ $$MLT' = \chi\frac{OD}{OD + ID} + (2 - \chi)\frac{ID}{OD + ID}$$

If one defines $$C \equiv \frac{ID}{OD},$$

then $$MLT' = \frac{\chi + (2 - \chi)C}{C + 1} \tag{3}$$

$$DCR' = \frac{\rho_{new}\frac{N_{new}(MLT_{new})}{A_{Wnew}}}{\rho\frac{N(MLT)}{A_W}} = \frac{1}{\beta}\frac{N'}{\delta^2}MLT' = \frac{1}{\beta}\frac{N'}{\delta^2}\left(\frac{\chi + (2 - \chi)C}{C + 1}\right) = \frac{1}{\beta}\frac{N'}{\delta^2}\left(\frac{N'\delta^2 + (2 - N'\delta^2)C}{C + 1}\right)$$

Note that the three performance parameters, I', DCR', and $\chi$ are functions of N' and $\delta$ in equations (1), (2), and (3).

It is recognized at this point that the performance parameters of electromagnetic actuators of the invention are considered improved when N' and $\delta$ are such that I'≤1, DCR'≤1, and $\chi \leq 1$. In other words, current, DCR, and/or window height are less than those values for the reference actuator.

To find the boundaries of design improvement regions of N' and $\delta$ for which this is true, three cases are considered. In the following the prime notation is dropped and all parameters are ratios.

Case 1: $\chi=1$ $I=1/N$ from (1)

$N=1/(\delta^2)$ from (2) (4)

Therefore, $I=\delta^2$ (5)

The result for N together with equation (3) produces $DCR=1/(\beta\delta^4)$ (6)

Case 2: I=1

$N=1$ from (1) (7)

$\chi=\delta^2$ from (2) (8)

These results inserted in (3) produce $$DCR=1/(\beta\delta^2)((\delta^2+(2-\delta^2)C)/(C+1)) \quad (9)$$

Case 3: DCR=1

If (2) is used to eliminate N in (3), then $\chi$ is solved resulting in $$\chi=(-C+[(C^2+(1-C^2)\beta\delta^4)]^{(1/2)})/(1-C) \quad (10)$$

$$N=(-C+[(C^2+(1-C^2)\beta\delta^4)]^{(1/2)})/((1-C)\delta^2) \text{ from (2)} \quad (11)$$

$$I=1/((-C+[(C^2+(1-C^2)\beta\delta^4)]^{(1/2)})/((1-C)\beta^2)) \text{ from (1)} \quad (12)$$

Now limits to the possible values of $\delta$ can be found in case 3, where the value of $\chi$ in equation 10 must be $\leq 1$. This results in $\delta\leq[(1/\beta)]^{(1/4)}$ for case 3 to apply as an improvement. On the other hand, in case 2 DCR$\leq$1. This condition results in $\delta\geq[(2C/(\beta(C+1)-(1-C)))]^{(1/2)}$.

Similar to the equations for electromagnetic actuators shown in FIG. 1 and FIG. 2, electromagnetic actuator of FIG. 3 also follows some of the above equations i.e. equation 1 and 2. However, since only L changes and OD and ID remain the same, following changes occur.

$$MLT' = 1 \quad (13)$$

$$DCR' = \frac{1}{\beta}\frac{N'}{\delta^2}$$

The boundaries of regions of design improvement are found for the three cases as well as the limits for $\delta$ for each of the cases in the same manner as above.

In accordance with exemplary embodiments of the present invention, if the conductivity of composite material used in the coil is $\beta$ times that of coil made of copper used in reference actuator, then diameter ratio/effective diameter ratio ($\delta$) can be within a range of 1 to about $$\left(\frac{2C}{\beta(C+1)-(1-C)}\right)^{\frac{1}{2}}.$$

In accordance with exemplary embodiments of the present invention, when the effective diameter ratio is selected to be within a sub-range 1 to about $(\beta)^{-1/4}$ of the entire range from 1 to about $$\left(\frac{2C}{\beta(C+1)-(1-C)}\right)^{\frac{1}{2}},$$

the number of turns value of the coil of the actuator is within a region having its upper limit defined by $(\delta^{-2})$ and a lower limit about 1. Within this sub-range, the direct current resistance (DCR) value is within a region having its upper limit defined by $[(\beta^{(-1)}*\delta^{(-4)}]$ and a lower limit defined by $$\frac{1}{\beta\delta^2}\left(\frac{\delta^2+(2-\delta^2)C}{C+1}\right).$$

The magnetizing current value of the actuator is within a region having its upper limit about 1 and a lower limit defined by $(\delta^2)$. The window height ratio of the magnetic core is within a region having its upper limit about 1 and a lower limit defined by $(\delta^2)$.

Figure 9:
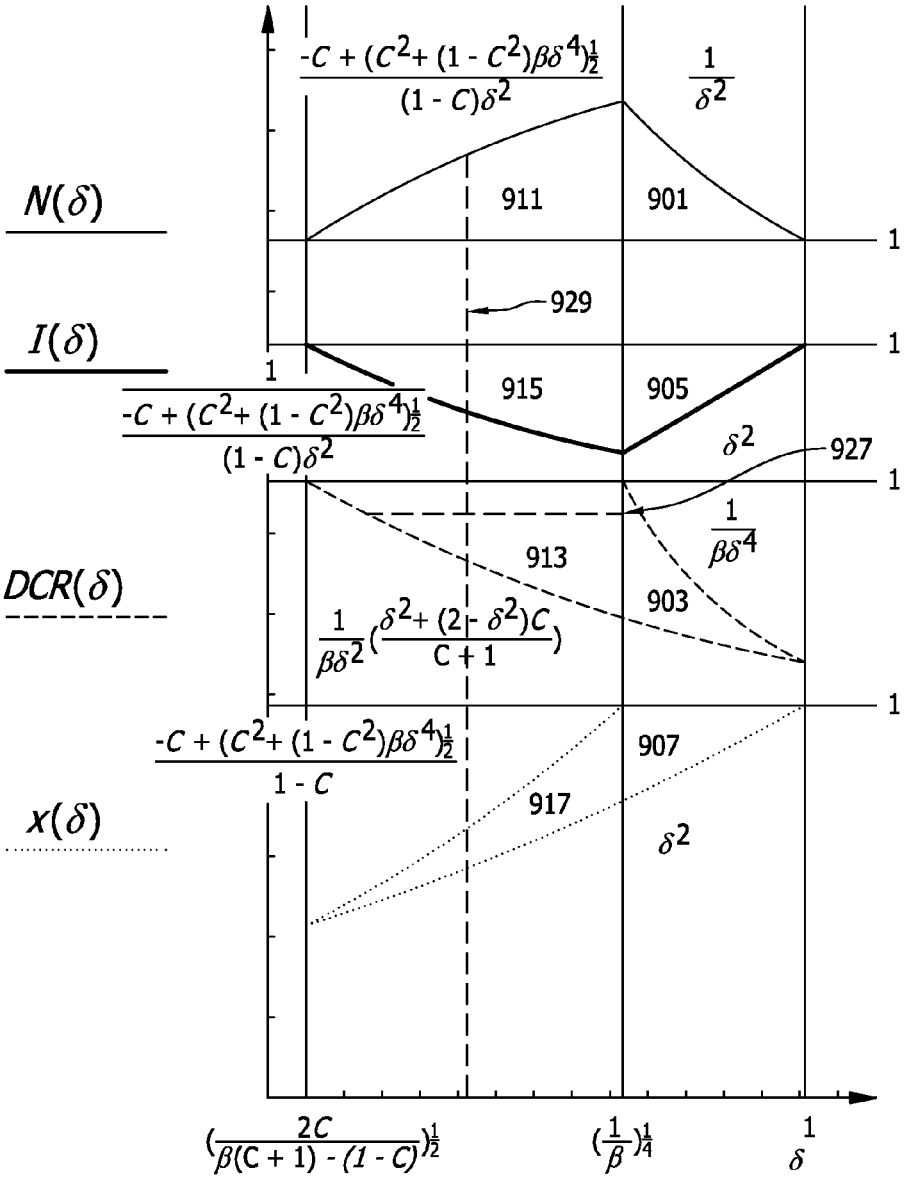
FIG. 9 is an exemplary graph showing optimal bounded performance improvement regions for exemplary embodiments of an electromagnetic actuator including an improved conductivity composite conductor material.

FIG. 9, shows bounded regions of electromagnetic actuator design performance improvement for all the performance parameters within the above mentioned sub-ranges. Region 901 shows a bounded performance improvement region in number of turns (N), region 903 shows a bounded performance improvement region in direct current resistance (DCR), region 905 shows a bounded performance improvement region in magnetizing current (I), region 907 shows a bounded performance improvement region in window height ratio ($\chi$).

In accordance with exemplary embodiments of the present invention, when the effective diameter ratio is selected to be within a sub-range of about $(\beta)^{-1/4}$ to about $$\left(\frac{2C}{\beta(C+1)-(1-C)}\right)^{\frac{1}{2}}$$

of the entire range from 1 to about $$\left(\frac{2C}{\beta(C+1)-(1-C)}\right)^{\frac{1}{2}},$$

the number of turns value of the coil of the actuator is within a bounded performance improvement region having its upper limit or boundary value defined by $$\frac{-C+(C^2+(1-C^2)\beta\delta^4)^{\frac{1}{2}}}{(1-C)\delta^2}$$

and a lower limit about 1. Within this sub-range, the direct current resistance (DCR) value is within a bounded performance improvement region having its upper limit or boundary value of about 1 and a lower limit defined by $$\frac{1}{\beta\delta^2}\left(\frac{\delta^2+(2-\delta^2)C}{C+1}\right).$$

The magnetizing current value of the actuator is within a bounded performance improvement region having its upper limit or boundary value of about 1 and a lower limit defined by $$\frac{1}{\frac{-C+(C^2+(1-C^2)\beta\delta^4)^{\frac{1}{2}}}{(1-C)\delta^2}}.$$

The window height ratio of the magnetic core is within a bounded performance improvement region having its upper limit or boundary value defined by $$\frac{-C+(C^2+(1-C^2)\beta\delta^4)^{\frac{1}{2}}}{1-C}$$

and a lower limit defined by $(\beta^2)$.

FIG. 9, shows the regions of electromagnetic actuator design and performance improvement for all the performance parameters within the above mentioned sub-ranges. Region 911 shows performance improvement in number of turns (N), region 913 shows performance improvements in direct current resistance (DCR), region 915 shows performance improvements in magnetizing current (I), region 917 shows performance improvements in window height ratio ($\chi$).

The improvement regions 901, 903, 905, 907, 911, 913, 915 and 917 shown in FIG. 9 are defined and shown to be bounded by broken lines represented by the values and functions described above and shown in FIG. 9. The boundary lines, corresponding to the values and functions described and shown for each improvement region 901, 903, 905, 907, 911, 913, 915 and 917 define the bounded regions such that any value between and including the boundary lines may be utilized to design and fabricate a an electromagnetic actuator according to the present invention that will be improved, or optimized, relative to the reference actuator in at least one aspect. A desired value of diameter ratio ($\delta$) for an actuator component of the present invention can be any value within these boundaries to provide an actuator component having improved parameters or characteristics relative to the reference electromagnetic actuator.

However, if the diameter ratio ($\delta$) is selected to be outside the limits of the bounded regions 901, 903, 905, 907, 911, 913, 915 and 917 shown (i.e., outside the broken boundary line values corresponding to the functions and values described and shown for each region), the resultant actuator component including the improved higher conductivity composite material will be less desirable than the corresponding value of the reference actuator in at least one aspect. As one example, an actuator component may be constructed using the improved higher conductivity material to fabricate its coil that actually performs with direct current resistance (DCR) and hence higher power losses than the reference actuator using certain diameter ratios ($\delta$) that are outside the regions 903 and 913. That a higher conductivity composite material may be utilized to provide an electromagnetic actuator with higher power losses than the reference actuator utilizing a conventional conductive material having a lower conductivity (but otherwise similar design) is perhaps a counterintuitive result that is preferably avoided. Thus, the bounded regions shown provide a range of values, within and including the boundaries shown in which the corresponding values of an actuator component of the present invention constructed with values ($\beta$) and ($\delta$) is the same or better in terms than the corresponding values of the reference actuator.

It must be noted that the above range of effective diameter ratio ($\delta$) from 1 to about $$\left(\frac{2C}{\beta(C+1)-(1-C)}\right)^{\frac{1}{2}}$$

is selected to accomplish improvements in one or more performance parameters of the electromagnetic actuator, when there is a limitation to change only the outside diameter (114 in FIGS. 1 and 214 in FIG. 2) of the electromagnetic actuator and the length of the coil, (i.e., L in FIGS. 1 and 2) cannot change due to physical or design restrictions.

However, in cases where there is no restriction to change the length of the coil, but the outside diameter of the coil is fixed and cannot change due to physical or design requirements, such as in the actuator 300 shown in FIG. 3. The range of the diameter ratio ($\delta$) that allow improvement in some or all of the performance parameters, is about $$\left(\frac{1}{\beta}\right)^{\frac{1}{2}}$$

to about 1.

In accordance with exemplary embodiments of the present invention, when the effective diameter ratio is selected to be within a sub-range 1 to about $(\beta)^{-1/4}$ of the entire range from 1 to about $(\beta)^{-1/2}$, the number of turns value of the coil of the actuator is within a region having its upper limit defined by $(\delta^{-2})$ and a lower limit about 1. Within this sub-range, the direct current resistance (DCR) value is within a region having its upper limit defined by $$\frac{1}{\beta\delta^4}$$

and a lower limit defined by $$\frac{1}{\beta\delta^2}.$$

The magnetizing current value of the actuator is within an upper limit about 1 and a lower limit defined by $(\delta^2)$. The window height ratio of the magnetic core is within a region having its upper limit about 1 and a lower limit defined by $(\delta^2)$.

Figure 10:
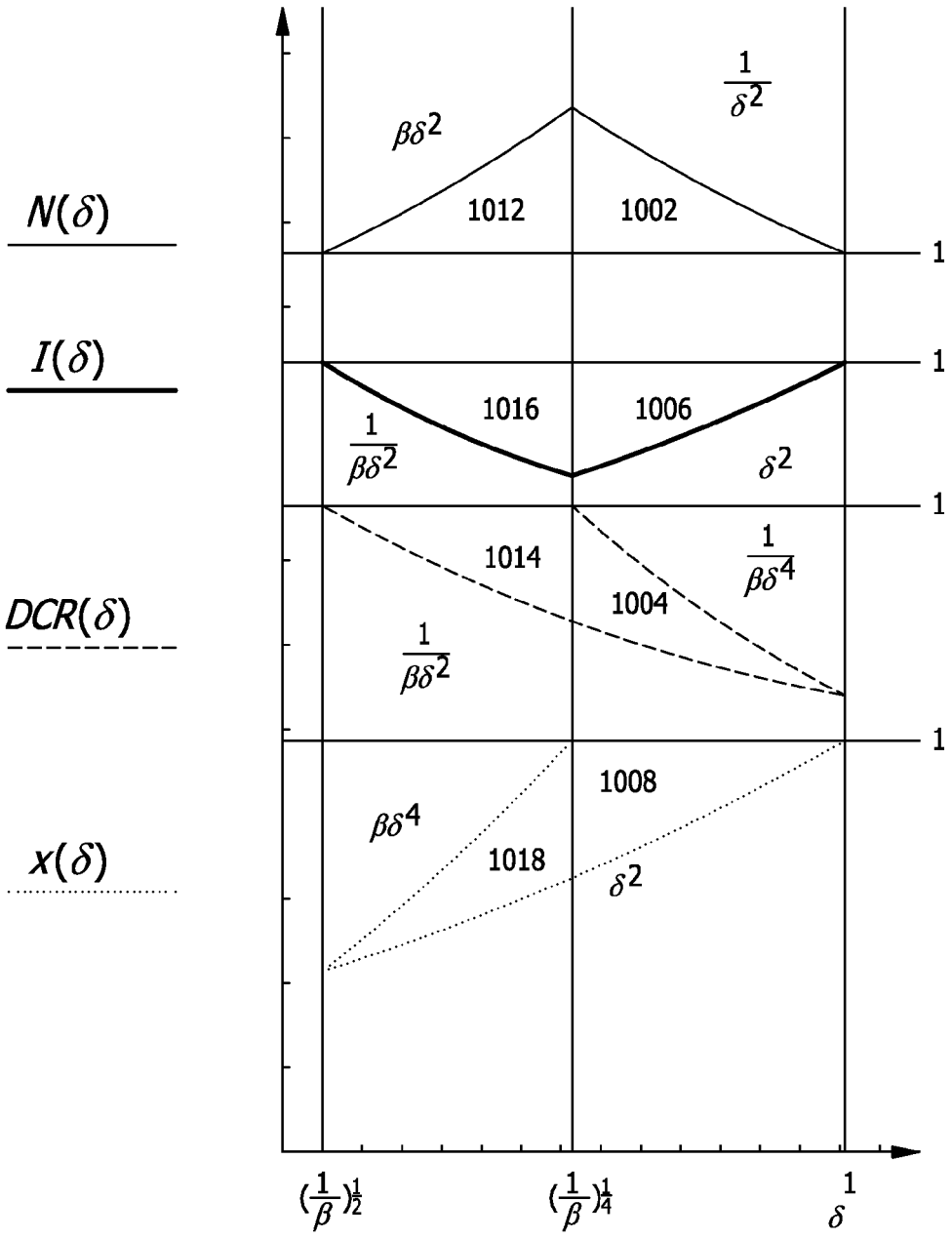
FIG. 10 is an exemplary graph showing additional optimal bounded performance improvement regions for exemplary embodiments of an electromagnetic actuator including an improved conductivity composite conductor material.

FIG. 10 shows the regions of performance improvement for all the performance parameters within the above mentioned sub-ranges. Region 1002 shows a bounded performance improvement region in number of turns (N), region 1004 shows a bounded performance improvement region in direct current resistance (DCR), region 1006 shows a bounded performance improvement region in magnetizing current (I), region 1008 shows a bounded performance improvement region in window height ratio ($\chi$).

In accordance with exemplary embodiments of the present invention, when the effective diameter ratio is selected to be within a sub-range $(\beta)^{-1/4}$ to $(\beta)^{-1/2}$ of the entire range from 1 to about $(\beta)^{-1/2}$, the number of turns value of the coil of the actuator is within a bounded performance improvement region having its upper limit defined by $\beta\delta^2$ and a lower limit about 1. Within this sub-range, the direct current resistance (DCR) value is within a region having its upper limit about 1 and a lower limit defined by $$\frac{1}{\delta^2}.$$

The magnetizing current value of the actuator is within a region having its upper limit defined by $$\frac{1}{\beta\delta^2}$$

and a lower lima about 1. The window height ratio of the magnetic core is within a bounded performance improvement region having its upper limit defined by $\beta\delta^4$ and a lower limit defined by ($\delta^2$).

FIG. 10, shows the regions of performance improvement for all the performance parameters within the above mentioned sub-ranges. Region 1012 shows a bounded performance improvement region in number of turns (N), region 1014 shows a bounded performance improvement region in direct current resistance (DCR), region 1016 shows a bounded performance improvement region in magnetizing current (I), region 1018 shows a bounded performance improvement region in window height ratio ($\chi$).

In accordance with exemplary embodiments of the invention, an electromagnetic actuator with improved performance parameters and characteristics is designed and manufactured. As described above, the improvement in the electromagnetic actuator of the present invention including improved conductivity material is realized in terms of ratios relative to the corresponding parameter that describes the reference actuator. As explained above, the electromagnetic performance parameters and characteristics include number of turns (N), direct current resistance (DCR), magnetizing current (I), window height ratio ($\chi$).

While designing an electromagnetic actuator in accordance with the invention, first a composite conductive material is provided.

Further, ratio of electrical conductivity ($\beta$) of the composite conductive material relative to the conductivity of copper used in reference design is determined.

After the ratio of electrical conductivity is determined, upper and lower limits of effective diameter ratio $\delta$ is determined and a performance parameter value of one of the performance parameters (as described above) is chosen/selected based on the requirement. The value of performance parameter is selected such that there exists at least one effective diameter ratio within the specified upper and lower limits for the selected value of the performance parameter.

Still further, the remaining three performance parameters are determined which fall within the respective performance improvement regions and correspond to the selected value of effective diameter ratio ($\delta$) and the one parameter.

For instance, an actuator designer first chooses one of the parameters of the reference actuator and a value ($\delta$) for which the new actuator design is to be improved. Suppose one chooses DCR=0.85. This value is plotted as a horizontal dashed line represented by reference numeral 927 in FIG. 9 within the improvement region for DCR. It must be noted that there is now a sub-range of the overall range of $\delta$ for which this value of improvement can be achieved. Secondly, one chooses a value of $\delta$ from this sub-range. At this point everything needed to implement the actuator design is defined. At the selected $\delta$ value, the number of turns remaining parameters (as defined above in equations 1, 2, and 3) are determined such that they fall within the performance improvement regions shown in FIG. 9. Since I is circuit dependent, the designer must then operate the actuator consistent with this value when connected to electrical circuitry.

In accordance with an alternate embodiment, one first chooses a value of effective diameter ratio $\delta$. For instance, a selected $\delta$ value is shown by a vertical dashed straight line 929 in FIG. 9 within the design improvement regions of the four performance parameters or characteristics illustrated. Then the user decides on parameter for which a desired target value is to be achieved. Once the desired value of the one parameter is chosen or selected, its value together with the chosen effective diameter ratio $\delta$ determines the values of the remaining three parameters which fall within their respective performance improvement regions as shown FIG. 9. Again, the actuator must be operated with the new value of I when connected to electrical circuitry.

Figure 11:
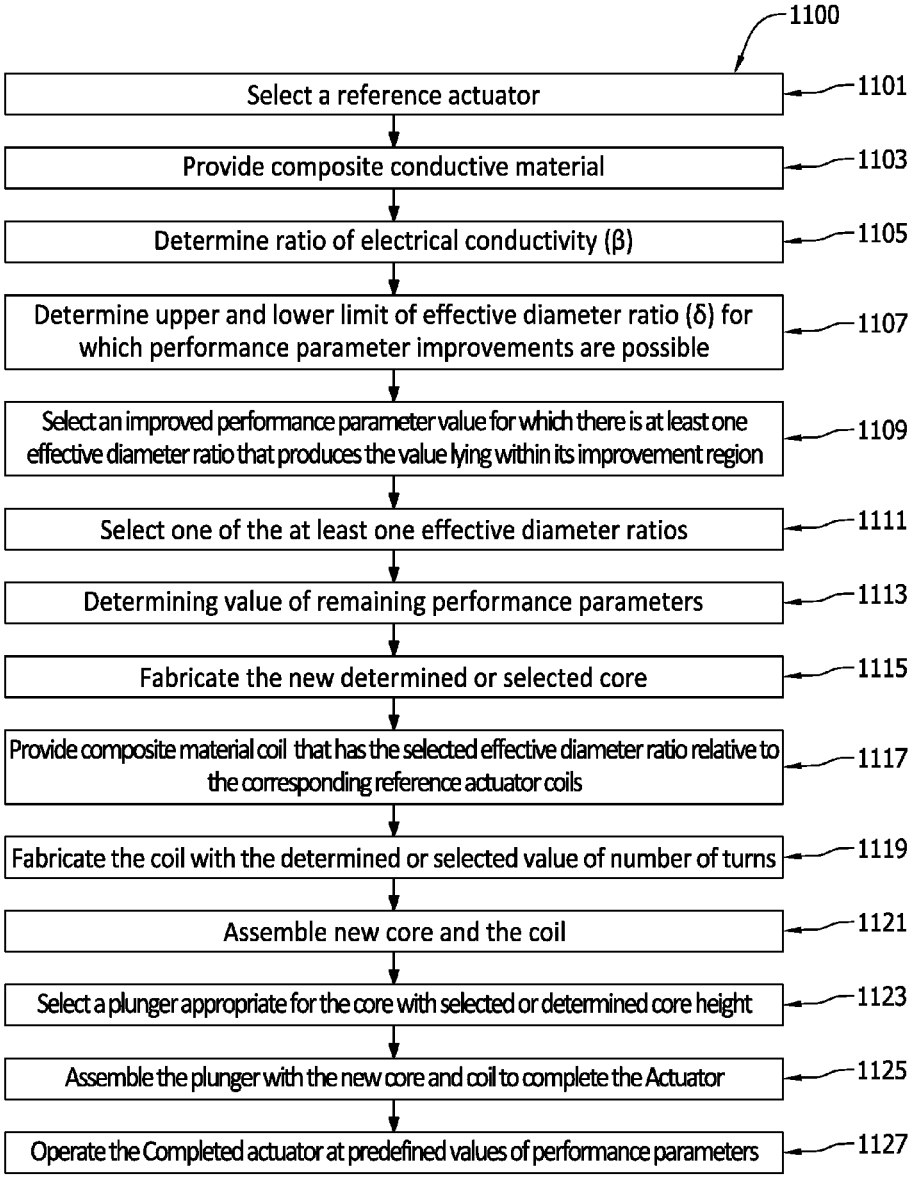
FIG. 11 illustrates an exemplary flowchart of a method of designing and manufacturing an electromagnetic actuator of the present invention including an improved conductivity composite conductor material.

FIG. 11 illustrates an exemplary flowchart of a method 1100 of manufacturing electromagnetic actuators in accordance with exemplary embodiments of the present invention.

At step 1101, a reference actuator is selected. The reference actuator is an actuator having reference core made of magnetic material and reference coil made of copper.

At step 1103, a composite conductive material having a conductivity greater than a conductivity of the reference conductor material is provided. The composite material may be any material described above or another material of a greater conductivity than the conductor material utilized in the reference actuator(s). Varying degrees of conductivity may be provided by different formulations of composite materials. The composite materials may be provided in flexible wire form, sheet form, or in a form that may be deposited on a substrate material. In some embodiments, the step of providing the composite material at step 1103 may include the step of manufacturing the composite conductive material. In other embodiments, the step of providing the composite material may include acquiring the material from another party, whether a manufacturer or a distributor, and making the composite material available for electromagnetic actuator fabrication.

At step 1105 a ratio is determined of electrical conductivity ($\beta$) of the composite conductor provided at step 1103 to the electrical conductivity of the reference conductor material of a reference actuator. While illustrated as a separate step, step 1103 and step 1105 may in practice be one and the same in certain embodiments. That is, one may select the composite material provided at step 1103 to achieve a desired conductivity ratio for purposes of step 1105. Alternatively, a composite conductive material could be provided and analyzed to determine its conductivity, which can then be used to determine the conductivity ratio.

As shown at step 1107, an upper limit and lower limit (or range) of an effective diameter ratio of the composite conductive material may be determined. The upper and lower limits are determined from the perspective of identifying a range of values between the limits in which a actuator parameter may be improved relative to the reference actuator. The determination of a range of an effective diameter ratio ($\delta$) is made in view of the determined ratio of electrical conductivity ($\beta$).

As shown at step 1109 one of the actuator parameter values (e.g., number of turns, magnetizing current, DC resistance, and window height ratio), is selected within the improvement regions such as those shown in FIGS. 9 and 10. The regions may be derived from theoretical relationships and computation. The actuator being designed would therefore have improved values with respect to the reference actuator regarding the parameters.

The regions may be developed for each respective actuator parameter or actuator performance parameters such as those described in the embodiments above, or other parameters as desired. The regions may be defined for each parameter of interest to include functions of the ratio of electrical conductivity ($\beta$) discussed above, which also relates to the effective diameter ratio ($\delta$) as described above. The regions of values may be defined by a function of the ratio of electrical conductivity ($\beta$) and the effective diameter ratio ($\delta$) as described above. It is understood that graphs such as those in FIGS. 9 and 10 may be helpful to do this, but are not necessary for the design improvement regions to be defined and utilized. The regions may be provided as a preparatory step to the method 1100 or may be determined as part of the method and provided for reference in the fabrication of an electromagnetic actuator including the material provided at step 1103. The selected value of performance parameter is a value that is desired to be achieved and this value will have at least one effective diameter ratio (δ) that produces this value. The at least one effective diameter ratio (δ) will generally lie within a sub-range of the effective diameter ratio (δ) determined in step 1107.

At step 1111, the at least one effective diameter ratio is selected. The selected effective diameter value is made with an objective, as described above, of maintaining or improving a parameter of the reference actuator(s). In some embodiments step 1111 may be consolidated with steps 1103 and 1105. For example, only one composite conductor with a given effective diameter may be provided at step 1103, such that the effective diameter at step 1111 may be effectively dictated by the composite material provided.

Once the selections at step 1109 and 1111 are done, the remaining parameters of the actuator design are now determined at step 1113.

At step 1115, a magnetic core structure is fabricated. As discussed above, the core structure may be formed in one piece or multiple pieces having the same or different shape.

At step 1117, a composite material coil (as described above) is provided for coil that has the selected at least one effective diameter ratio relative to the corresponding reference actuator coil.

At step 1119, the coil is fabricated from the composite material provided at step 2303, having the conductivity determined at step 1105, and having the effective diameter ratio determined at step 1111. The coil is formed with a number of turns selected or determined at step 1109 and 1113, respectively, to achieve the desired improvement. Any of the techniques and coil configurations described above may be utilized to construct the coil at step 1119.

At step 1121, the core and coil is assembled to exhibit the parameter values selected at steps 1109 and 1113. In some embodiments, the steps of 1109, 1111, 1113, 1115, 1117, 1119, and 1121 may occur at the same time. As one such example, in a laminated actuator construction including magnetic sheets, the magnetic sheets may be pressed around the coil to fabricate the magnetic core structure. As another example, in a laminated actuator construction including layers successively formed on a preexisting layer, the coil may simultaneously be formed with the magnetic core structure.

At step 1123, a plunger appropriate for the core with selected or determined core height is selected. The selection of the plunger includes identifying an appropriate material for the plunger, selecting an appropriate shape for the fabricated core, fabricating the plunger and/or acquiring a plunger from a third party and making it available for assembling electromagnetic actuators according to the present invention.

At step 1125, the plunger is assembled with the new core and coil to complete the electromagnetic actuator component.

At step 1127, the completed actuator is operated at the predefined values of performance parameters associated with core and coil after being connected to electrical circuitry.

While an exemplary method 1100 has been described, the method and process steps may be performed using less than all of the steps shown, with additional steps included and/or the method and process steps may be performed in a different order. Various adaptations are possible within the scope of the pending claims.

Figure 12:
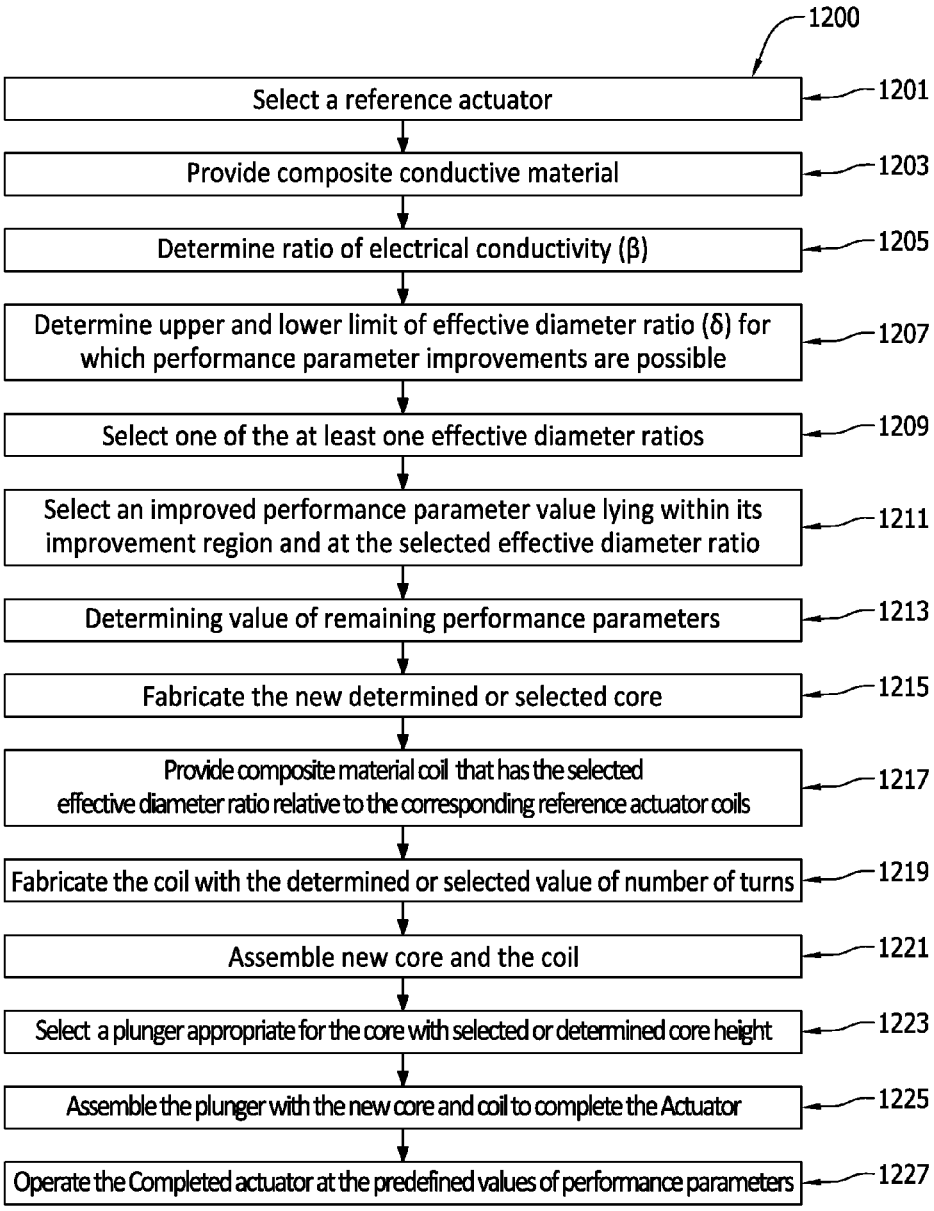
FIG. 12 illustrates another exemplary flowchart of a method of manufacturing electromagnetic actuator of the present invention including an improved conductivity composite conductor material.

FIG. 12 illustrates another exemplary flowchart of a method 1200 of manufacturing electromagnetic actuator in accordance with exemplary embodiments of the present invention.

At step 1201, a reference actuator is selected. The reference actuator is an actuator having reference core made of magnetic material and reference coil made of copper.

At step 1203, a composite conductive material having a conductivity greater than a conductivity of the reference conductor material is provided. The composite material may be any material described above or another material of a greater conductivity than the conductor material utilized in the reference actuator(s). Varying degrees of conductivity may be provided by different formulations of composite materials. The composite materials may be provided in flexible wire form, sheet form, or in a form that may be deposited on a substrate material. In some embodiments, the step of providing the composite material at step 1203 may include the step of manufacturing the composite conductive material. In other embodiments, the step of providing the composite material may include acquiring the material from another party, whether a manufacturer or a distributor, and making the composite material available for electromagnetic actuator fabrication.

At step 1205, a ratio is determined of electrical conductivity (β) of the composite conductor provided at step 1203 to the electrical conductivity of the reference conductor material of for a reference actuator. While illustrated as a separate step, step 1203 and step 1205 may in practice be one and the same in certain embodiments. That is, one may select the composite material provided at step 1203 to achieve a desired conductivity ratio for purposes of step 1205. Alternatively, a composite conductive material could be provided and analyzed to determine its conductivity, which can then be used to determine the conductivity ratio.

As shown at step 1207, an upper limit and lower limit (or range) of an effective diameter ratio of the composite conductive material may be determined. The upper and lower limits are determined from the perspective of identifying a range of values between the limits in which a actuator parameter may be improved relative to the reference actuator. The determination of range of an effective diameter ratio (δ) is done on the basis of determined ratio of electrical conductivity (β).

At step 1209, the at least one effective diameter ratio is selected based on the requirement of the user/designer. The selected effective diameter ratio is within the upper and lower limits of the effective diameter ratio.

As shown at step 1211 one of the actuator parameter values (number of turns, magnetizing current, DC resistance, and window height ratio), is selected within improvement regions such as those shown in FIGS. 9 and 10. The regions may be derived from theoretical relationships and computation. The actuator being designed would therefore have improved values with respect to the reference actuator regarding the parameters. The parameter whose value selected at this step is the parameter for which desired target value is to be achieved.

The design improvement regions may be developed for each respective actuator parameter or actuator performance parameters such as those described in the embodiments above, or other parameters as desired. The regions may be defined for each parameter of interest to include functions of the ratio of electrical conductivity (β) discussed above, which also relates to the effective diameter ratio (δ) as described above. The regions of values may be defined by a function of the ratio of electrical conductivity (β) and the effective diameter ratio (δ) as described above. It is understood that graphs such as those in FIGS. 9 and 10 may be helpful to do this, but are not necessary for the regions to be defined and utilized. The regions may be provided as a preparatory step to the method 1200 or may be determined as part of the method and provided for reference in the fabrication of an electromagnetic actuator including the material provided at step 1203. The selected value of performance parameter is a value that is desired to be achieved and this value will have at least one effective diameter ratio (δ) that produces this value. The at least one effective diameter ratio (δ) will generally lie within a sub-range of the effective diameter ratio (δ) determined in step 1209.

Once the selections at step 1209 and 1211 are done, the remaining parameters of the actuator design are now determined at step 1213 which lie within their respective regions of performance improvement.

At step 1215, a core structure is fabricated. As discussed above, the core structure may be formed in one piece or multiple pieces having the same or different shape.

At step 1217, composite material (as described above) is provided for the coil that has the selected at least one effective diameter ratio relative to the corresponding reference actuator coil.

At step 1219, coil is fabricated from the composite material provided at step 1203, having the conductivity determined at step 1205, and having the effective diameter ratio determined at step 1211. The coil is formed with a number of turns selected or determined at steps 1209 or 1213, to achieve the desired improvement. Any of the techniques and coil configurations described above may be utilized to construct the coil at step 1219.

At step 1221, the core and coil is assembled to exhibit the parameter values selected or determined at steps 1209, 1211, and 1213. In some embodiments, the steps of 1209, 1211, 1213, 1215, 1217, 1219, and 1221 may occur at the same time. As one such example, in a laminated actuator construction including magnetic sheets, the magnetic sheets may be pressed around the coil to fabricate the magnetic core structure. As another example, in a laminated actuator construction including layers successively formed on a preexisting layer, the coil may simultaneously be formed with the magnetic core structure.

At step 1223, a plunger appropriate for the core with selected or determined core height is selected. The selection of plunger includes identifying right material, selecting an appropriate shape for the fabricated core.

At step 1225, the plunger is assembled with the new core and coil to complete the actuator. The selection of the plunger includes identifying an appropriate material for the plunger, selecting an appropriate shape for the fabricated core, fabricating the plunger and/or acquiring a plunger from a third party and making it available for assembling electromagnetic actuators according to the present invention.

At step 1227, the completed actuator is operated at the predefined values of performance parameters associated with core and coil after being connected to electrical circuitry.

While an exemplary method 1200 has been described, the method and process steps may be performed using less than all of the steps shown, with additional steps included and/or the method and process steps may be performed in a different order. Various adaptations are possible within the scope of the pending claims.

Electromagnetic actuators formed according to the present invention may therefore be readily obtained in view of the teachings of the present disclosure, without necessarily undertaking the laborious task of theoretical actuator design, and without necessarily incurring expensive and time consuming experimentation of new actuator constructions. Improved actuators having better performance may be provided at relatively low cost while continuing to reduce the physical package size of actuators and/or improving actuator performance in different aspects or a combination of aspects. In view of the inventive design approach described above, a vast number of copper-based actuators can be readily translated to new and improved actuator devices using ultra-conductive composite materials. Actuator designs can rather easily be optimized with respect to one or more of a plurality of parameters. The benefits of such actuators according to the invention are perhaps most significant for electromagnetic actuators of all sizes.

The benefits and advantages of the inventive concepts are now believed to have been amply illustrated in relation to the exemplary embodiments disclosed.

An embodiment of an electromagnetic actuator has been disclosed including: a magnetic core; a conductor fabricated from a composite conductive material including carbon nanotubes, the conductor shaped to form a coil completing a number of turns; and an actuator, wherein one of the actuator and the core is movable relative to the other of the actuator and the core under an influence of an electromagnetic field induced in the magnetic core; wherein the conductor has a first cross sectional area defined by an effective diameter that is selected relative to a reference electromagnetic actuator including a reference conductor material having a second cross sectional area defined by a reference effective diameter.

Optionally, a ratio of an electrical conductivity (β) of the conductor to an electrical conductivity of the reference conductor material in the reference electromagnetic actuator may be greater than 1; and the ratio of electrical conductivity (β) may define an upper limit and a lower limit for the selected effective diameter. The actuator may be configured to operate with performance parameters selected from the group of a magnetic field density, direct current resistance value, a magnetizing current value, a window height ratio, and a number of turns value when connected to electrical circuitry; and wherein one of the performance parameters is predetermined to match a corresponding performance parameter of the reference actuator and wherein a performance value of at least one of the performance parameters may be selected to be within a respective bounded design improvement region defined by the ratio of electrical conductivity (β) and an effective diameter ratio (δ) of the conductor relative to the reference conductor material. The magnetic field density may be predetermined to match the corresponding value of the reference actuator. A performance value of a plurality of the other performance parameters may be selected to be within a respective region defined by the ratio of electrical conductivity (β) and the effective diameter ratio (δ) of the conductor relative to the reference conductor material.

As further options, the ratio of electrical conductivity (β) may be within a range of about 1.1 to about 10. The composite material including carbon nanotubes may be an ultra-conductive copper composite material.

An effective diameter ratio (δ) of the conductor relative to the reference conductor may be within a range defined by and including a function $$\left(\frac{2C}{\beta(C+1)-(1-C)}\right)^{\frac{1}{2}},$$

wherein C is a ratio of effective inner diameter of the reference coil wound over the core to effective outer diameter of reference coil wound over the core.

An effective diameter ratio (δ) of the conductor relative to the reference conductor may be within a range defined between and including 1 and a function $(\beta)^{-1/4}$. A number of turns value of the coil of the actuator may be within an upper limit defined by and including a function $(\delta^{-2})$ and 1. A direct current resistance (DCR) value may be within a bounded improvement region defined between and including a function $[\beta^{(-1)}*\delta^{(-4)}]$ and a function $$\frac{1}{\beta\delta^2}\left(\frac{\delta^2+(2-\delta^2)C}{C+1}\right).$$

A magnetizing current value of the actuator may be within a bounded improvement region defined between and including 1 and a function $(\delta^2)$. A window height ratio of the magnetic core may be within a bounded improvement region defined between and including 1 and a function $(\delta^2)$.

As still other options, an effective diameter ratio (δ) of the conductor relative to the reference conductor may be within a bounded improvement region defined between and including a function $(\beta)^{-1/4}$ and $$\left(\frac{2C}{\beta(C+1)-(1-C)}\right)^{\frac{1}{2}}.$$

A number of turns value of the coil of the actuator may be within a bounded improvement region defined between and including a function $$\frac{-C+(C^2+(1-C^2)\beta\delta^4)^{\frac{1}{2}}}{(1-C)\delta^2}$$

and 1. A direct current resistance (DCR) value may be within a bounded improvement region defined between and including 1 and a function $$\frac{1}{\beta\delta^2}\left(\frac{\delta^2+(2-\delta^2)C}{C+1}\right).$$

A magnetizing current value of the actuator may be within a bounded improvement region defined between 1 and a function $$\frac{1}{\frac{-C+(C^2+(1-C^2)\beta\delta^4)^{\frac{1}{2}}}{(1-C)\delta^2}}.$$

A window height ratio of the magnetic core may be within a bounded improvement region defined between and including a function $$\frac{-C+(C^2+(1-C^2)\beta\delta^4)^{\frac{1}{2}}}{1-C}$$

and a function $(\delta^2)$.

As other options, an effective diameter ratio (δ) of the conductor relative to the reference conductor is within a bounded improvement region defined between 1 and a function $$\left(\frac{1}{\beta}\right)^{\frac{1}{2}}.$$

An effective ammeter ratio (δ) of the conductor relative to the reference conductor may be within a range defined by and including 1 and $(\beta)^{-1/4}$. A number of turns value of the coil of the actuator may be within a bounded improvement region defined by and including a function $(\delta^{-2})$ and 1. A direct current resistance (DCR) value is within a bounded improvement region defined by and including an upper boundary value defined by a function $$\frac{1}{\beta\delta^4}$$

and a lower boundary defined by a function $$\frac{1}{\beta\delta^2}.$$

A magnetizing current value of the actuator is within a bounded improvement region defined by and including an upper boundary value of 1 and a lower boundary value defined by a function $(\delta^2)$. A window height ratio of the magnetic core may be within a bounded improvement region defined by and including an upper boundary value of 1 and a lower boundary value defined by $(\delta^2)$.

An effective diameter ratio (δ) of the conductor relative to the reference conductor may also be within a range defined by and including a function $(\beta)^{-1/4}$ and a function $(\beta)^{-1/2}$. A number of turns value of the coil of the actuator may be within a bounded improvement region defined by and including an upper boundary value define by a function $\beta\delta^2$ and a lower boundary value of 1. A direct current resistance (DCR) value may be within a bounded improvement region defined by and including an upper boundary value of 1 and a lower boundary value defined by $$\frac{1}{\beta\delta^2}.$$

A magnetizing current value of the actuator may be within a bounded improvement region defined by an lower boundary value of a function $$\frac{1}{\beta\delta^2}$$

and a upper boundary value of 1. A window height ratio of the magnetic core may be within a bounded improvement region defined by an upper boundary value defined by a function $\beta\delta^4$ and a lower boundary value defined by $(\delta^2)$.

The reference conductor in different options may be fabricated from one of copper, copper alloy, aluminum, aluminum alloy, silver, or silver alloy. The cross section of the conductor may not be round. The cross section of the core may not be circular. The cross section of the core may be square. The composite material may include 0.1% to 100%, by weight, of carbon nanotubes.

An embodiment of a method of manufacturing an electromagnetic actuator has also been disclosed including: selecting a reference actuator having reference core made of magnetic material and reference coil made of copper; providing a composite conductive material having a conductivity greater than a conductivity of a reference conductor material; determining a ratio of electrical conductivity (β) of the composite conductor to the electrical conductivity of the reference conductor material; based on the determined ratio of electrical conductivity (β), determining an upper limit and lower limit of an effective diameter ratio (δ) of the composite conductive material relative to the reference conductor material.

The actuator may be configured to operate based on performance parameters selected from the group of a direct current resistance value, a magnetizing current value, a window height ratio, and a number of turns value when connected to electrical circuitry; and the method may further include selecting a value of one of the performance parameters within a respective bounded region of improvement values defined by a function of at least one of the ratio of electrical conductivity (β) and the effective diameter ratio (δ). The method may also include: selecting an effective diameter ratio within the determined upper and lower limit of the effective diameter ratio (δ); and determining values of the remaining performance parameters.

The method may also optionally include: fabricating a magnetic core having the selected window height ratio; fabricating a coil from the provided composite conductive material having an effective diameter, the effective diameter being determined based on the selected effective diameter ratio (δ); assembling the fabricated magnetic core and the fabricated coil; and assembling an actuator element with the core such that one of the actuator and the core is movable relative to the other of the actuator element and the core under the influence of a magnetic field induced within the core.

Selecting one of the performance parameters from one of the respective bounded regions of values may optionally include selecting one of the performance parameter from a bounded region of values defined by an upper or lower boundary value that is a function of at least one of the ratio of electrical conductivity (β) and the effective diameter ratio (δ). The method may also include fabricating an electromagnetic actuator component having a selected effective diameter and the selected conductivity value to achieve at least one of the selected performance parameters.

The actuator may be configured to operate based on performance parameters selected from the group of a direct current resistance value, a magnetizing current value, a window height ratio, and a number of turns value when connected to electrical circuitry; and the method may include selecting an effective diameter ratio within the determined upper and lower limit of the effective diameter ratio (δ).

The method may further include: selecting a value of one of the performance parameters within a respective bounded region of values defined by a function of at least one of the ratio of electrical conductivity (β) and the selected effective diameter ratio (δ); and determining values of the remaining performance parameters. The method may also include: fabricating a magnetic core having the selected window height ratio; fabricating a coil from the provided composite conductive material having an effective diameter, the effective diameter being determined based on the selected effective diameter ratio (δ); assembling the fabricated magnetic core and the fabricated coil; and assembling a plunger with the core to move under the influence of a magnetic field with in the core. Selecting one of the performance parameters from one of the respective regions of values may include selecting one of the performance parameters from a region of values that is defined by at least one limit that is a function of at least one of the ratio of electrical conductivity (β) and the effective diameter ratio (δ). The method may also include fabricating an electromagnetic component having a selected effective diameter and the selected conductivity value to achieve at least one of the selected performance parameters.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electromagnetic actuator comprising:

a magnetic core;

a conductor fabricated from a composite conductive material including carbon nanotubes, the conductor shaped to form a coil completing a number of turns; and an actuator, wherein one of the actuator and the core is movable relative to the other of the actuator and the core under an influence of an electromagnetic field induced in the magnetic core;

wherein the conductor has a first cross sectional area defined by an effective diameter that is selected relative to a reference electromagnetic actuator including a reference conductor material having a second cross sectional area defined by a reference effective diameter.

2. The electromagnetic actuator of claim 1;

wherein a ratio of an electrical conductivity (β) of the conductor to an electrical conductivity of the reference conductor material in the reference electromagnetic actuator is greater than 1; and wherein the ratio of electrical conductivity (β) defines an upper limit and a lower limit for the selected effective diameter.

3. The electromagnetic actuator of claim 2:

wherein the actuator is configured to operate with performance parameters selected from the group of a magnetic field density, direct current resistance value, a magnetizing current value, a window height ratio, and a number of turns value when connected to electrical circuitry; and wherein one of the performance parameters is predetermined to match a corresponding performance parameter of the reference actuator and wherein a performance value of at least one of the performance parameters is selected to be within a respective bounded design improvement region defined by the ratio of electrical conductivity (β) and an effective diameter ratio (δ) of the conductor relative to the reference conductor material.

4. The electromagnetic actuator of claim 3, wherein the magnetic field density is predetermined to match the corresponding value of the reference actuator.

5. The electromagnetic actuator of claim 3, wherein a performance value of a plurality of the other performance parameters is selected to be within a respective region defined by the ratio of electrical conductivity (β) and the effective diameter ratio (δ) of the conductor relative to the reference conductor material.

6. The electromagnetic actuator of claim 2, wherein the ratio of electrical conductivity (β) is within the range of about 1.1 to about 10.

7. The electromagnetic actuator of claim 6, wherein the composite material including carbon nanotubes is an ultra-conductive copper composite material.

8. The electromagnetic actuator of claim 3, wherein an effective diameter ratio (δ) of the conductor relative to the reference conductor is within a range defined by and including a function $$\left(\frac{2C}{\beta(C+1)-(1-C)}\right)^{\frac{1}{2}},$$

wherein C is a ratio of effective inner diameter of the reference coil wound over the core to effective outer diameter of reference coil wound over the core.

9. The electromagnetic actuator of claim 8, wherein an effective diameter ratio (δ) of the conductor relative to the reference conductor is within a range defined between and including 1 and a function $(\beta)^{-1/4}$.

10. The electromagnetic actuator of claim 9, wherein a number of turns value of the coil of the actuator is within an upper limit defined by and including a function $(\delta^{-2})$ and 1.

11. The electromagnetic actuator of claim 9, wherein a direct current resistance (DCR) value is within a bounded improvement region defined between and including a function $[\beta^{(-1)}*\delta^{(-4)}]$ and a function $$\frac{1}{\beta\delta^2}\left(\frac{\delta^2+(2-\delta^2)C}{C+1}\right).$$

12. The electromagnetic actuator of claim 9, wherein a magnetizing current value of the actuator is within a bounded improvement region defined between and including 1 and a function $(\delta^2)$.

13. The electromagnetic actuator of claim 9, wherein a window height ratio of the magnetic core is within a bounded improvement region defined between and including 1 and a function $(\delta^2)$.

14. The electromagnetic actuator of claim 8, wherein an effective diameter ratio (δ) of the conductor relative to the reference conductor is within a bounded improvement region defined between and including a function $(\beta)^{-1/4}$ and $$\left(\frac{2C}{\beta(C+1)-(1-C)}\right)^{\frac{1}{2}}.$$

15. The electromagnetic actuator of claim 14, wherein a number of turns value of the coil of the actuator is within a bounded improvement region defined between and including a function $$\frac{-C+(C^2+(1-C^2)\beta\delta^4)^{\frac{1}{2}}}{(1-C)\delta^2}$$

and 1.

16. The electromagnetic actuator of claim 14, wherein a direct current resistance (DCR) value is within a bounded improvement region defined between and including 1 and a function $$\frac{1}{\beta\delta^2}\left(\frac{\delta^2+(2-\delta^2)C}{C+1}\right).$$

17. The electromagnetic actuator of claim 14, wherein a magnetizing current value of the actuator is within a bounded improvement region defined between 1 and a function $$\frac{1}{\frac{-C+(C^2+(1-C^2)\beta\delta^4)^{\frac{1}{2}}}{(1-C)\delta^2}}.$$

18. The electromagnetic actuator of claim 14, wherein a window height ratio of the magnetic core is within a bounded improvement region defined between and including a function $$\frac{-C+(C^2+(1-C^2)\beta\delta^4)^{\frac{1}{2}}}{1-C}$$

and a function $(\delta^2)$.

19. The electromagnetic actuator of claim 3, wherein an effective diameter ratio (δ) of the conductor relative to the reference conductor is within a bounded improvement region defined between 1 and a function $$\left(\frac{1}{\beta}\right)^{\frac{1}{2}}.$$

20. The electromagnetic actuator of claim 19, wherein an effective diameter ratio (δ) of the conductor relative to the reference conductor is within a range defined by and including 1 and $(\beta)^{-1/4}$.

21. The electromagnetic actuator of claim 20, wherein a number of turns value of the coil of the actuator is within a bounded improvement region defined by and including a function $(\delta^{-2})$ and 1.

22. The electromagnetic actuator of claim 20, wherein a direct current resistance (DCR) value is within a bounded improvement region defined by and including an upper boundary value defined by a function $$\frac{1}{\beta\delta^4}$$

and a lower boundary defined by a function $$\frac{1}{\beta\delta^2}.$$

23. The electromagnetic actuator of claim 20, wherein a magnetizing current value of the actuator is within a bounded improvement region defined by and including an upper boundary value of 1 and a lower boundary value defined by a function $(\delta^2)$.

24. The electromagnetic actuator of claim 20, wherein a window height ratio of the magnetic core is within a bounded improvement region defined by and including an upper boundary value of 1 and a lower boundary value defined by $(\delta^2)$.

25. The electromagnetic actuator of claim 19, wherein an effective diameter ratio $(\delta)$ of the conductor relative to the reference conductor is within a range defined by and including a function $(\beta)^{-1/4}$ and a function $(\beta)^{-1/2}$.

26. The electromagnetic actuator of claim 25, wherein a number of turns value of the coil of the actuator is within a bounded improvement region defined by and including an upper boundary value define by a function $\beta\delta^2$ and a lower boundary value of 1.

27. The electromagnetic actuator of claim 25, wherein a direct current resistance (DCR) value is within a bounded improvement region defined by and including an upper boundary value of 1 and a lower boundary value defined by $$\frac{1}{\beta\delta^2}.$$

28. The electromagnetic actuator of claim 25, wherein a magnetizing current value of the actuator is within a bounded improvement region defined by an lower boundary value of a function $$\frac{1}{\beta\delta^2}$$

and a upper boundary value of 1.

29. The electromagnetic actuator of claim 25, wherein a window height ratio of the magnetic core is within a bounded improvement region defined by an upper boundary value defined by a function $\beta\delta^4$ and a lower boundary value defined by $(\delta^2)$.

30. The electromagnetic actuator of claim 1, wherein the reference conductor is fabricated from one of copper, copper alloy, aluminum, aluminum alloy, silver, or silver alloy.

31. The electromagnetic actuator of claim 1, wherein the cross section of the conductor is not round.

32. The electromagnetic actuator of claim 1, wherein the cross section of the core is not circular.

33. The electromagnetic actuator of claim 1, wherein the cross section of the core is square.

34. The electromagnetic actuator of claim 1, wherein the composite material includes 0.1% to 100%, by weight, of carbon nanotubes.

* * * * *